US006604990B2

(12) United States Patent
Cooper et al.

(10) Patent No.: US 6,604,990 B2
(45) Date of Patent: Aug. 12, 2003

(54) POLISHING PAD AND METHOD OF PRODUCING THE SAME

(75) Inventors: Alex Cooper, Brooklyn, NY (US); Yevgeny Bederak, Long Meadow, MA (US); Sergey Vladimirtsev, Brooklyn, NY (US); Victor Liotta, Huntington Station, NY (US)

(73) Assignee: Universal Photonics Inc., Hicksville, NY (US)

( * ) Notice: Subject to any disclaimer, the term of this patent is extended or adjusted under 35 U.S.C. 154(b) by 0 days.

(21) Appl. No.: 09/943,390

(22) Filed: Aug. 31, 2001

(65) Prior Publication Data

US 2003/0049999 A1 Mar. 13, 2003

(51) Int. Cl.[7] ..... B24D 11/00

(52) U.S. Cl. ..... 451/526; 451/41; 451/533; 451/538; 451/550

(58) Field of Search ..... 451/41, 526, 533, 451/538, 550; 51/297, 298, 309

(56) References Cited

U.S. PATENT DOCUMENTS 3,653,857 A * 4/1972 Field ..... 451/490
5,989,111 A * 11/1999 Lamphere et al. ..... 451/526
6,372,336 B1 * 4/2002 Clausen et al. ..... 428/323

* cited by examiner

*Primary Examiner*—Joseph J. Hail, III
*Assistant Examiner*—Alvin J Grant
(74) *Attorney, Agent, or Firm*—I. Zborovsky

(57) ABSTRACT

A polishing pad for polishing glass and the like has a working layer with a plurality of polishing grains, an attaching layer with which the polishing pad is attachable to a polishing head of a power tool, and a connection layer which connects the working layer, with the attaching layer, and the connection layer is composed of vulcanizable material, which is vulcanized at certain temperature and under certain pressure and thereby connects the working layer with the attaching layer.

4 Claims, 1 Drawing Sheet

POLISHING PAD AND METHOD OF PRODUCING THE SAME

BACKGROUND OF THE INVENTION

The present invention relates generally to polishing pads and methods of producing the same.

Polishing pads for removing scratches from surfaces of polished glass and other objects are known. They are used on polishing machine tools for repair-polishing of front surfaces of airplane windows, etc. Some of such pads are disclosed in U.S. Pat. Nos. 4,969,914 and 4,709,513. Known polishing pads of this type which are identified as "hydro-pads" include a working layer, a body which supports the working layer, a "VELCRO"-type connecting layer for connecting the pad to a power tool, and a connection layer for connecting the body to the "VELCRO"-type connecting layer. The working layer of the pads is a polishing powder, for example $CeO_2$, with the particle size 1.5–5 $\mu$m, which are fixed by adhesive on the body. The body is formed as a non-knitted substrate which is covered by an adhesive suspension, on which polishing powder, for example $CeO_2$ is placed. Such a pad is shown in FIG. 1, wherein reference numeral 1 identifies a working layer including an adhesive 2 and a polishing powder with polishing grains 3 embedded in the adhesive 2, a body identified with reference numeral 4 and composed of a non-knitted material, a "VELCRO"-type layer including a carrier 5 and a plurality of projections formed for example as loops 7, and a connection layer 6 composed of a pressure sensitive adhesive. During the manufacture of the pad, the adhesive 2 of the working layer 1 s hardened and fixed with the grains 3 of the polishing powder on the surface of the body 4.

The above mentioned polishing pad has several disadvantages. The very small grains of the polishing powder with the size 1.5–5 micron located on the adhesive suspension must penetrate into the interior of the adhesive. However, the small size of the grains and their small weight as well as their relatively great surface and a viscosity of the adhesive suspension prevent a deep penetration of the grains into the adhesive suspension. The polishing grains 3 are fixed in the adhesive suspension only over 25–35% of their height. This is a reason for a low working ability and a minimal service life of the tool pad. During the operation of the pad, as a result of the displacement, pressure and temperature, the pressure sensitive adhesive of the connecting layer 6 looses its viscosity and the pad breaks apart, or in other words, the body 4 with the working layer 1 is separated from the "VELCRO-type layer 5–6.

SUMMARY OF THE INVENTION

Accordingly, it is an object of present invention to provide a polishing pad of the above mentioned general type which avoids the disadvantages of the prior art.

It is also an object of the present invention to provide a method of producing the polishing pad, which makes possible making of a polishing pad which eliminates the disadvantages of the prior art.

In keeping with these objects and with others which will become apparent hereinafter, one feature of present invention resides, briefly stated, in a polishing pad which has a working layer provided with a plurality of polishing grains; an attachment layer for attaching the pad to a power tool; and a connection layer located between said working layer and said attaching layer and composed of a vulcanizable polymeric material, such that when the working layer is applied on the attaching layer with heat and pressure, the connection layer is vulcanized and immovably connects the working layer to the attaching layer.

In accordance with another feature of the present invention a method of producing of a polishing pad is proposed, which includes the steps of providing a working layer with a plurality of polishing grains; providing an attachment layer for attaching the pad to a power tool; and connecting the working layer with the attaching layer by providing a vulcanizable polymeric layer between them and applying a temperature and pressure sufficient for vulcanization of the connection layer so as to connect the working layer with the attaching layer by the connection layer.

When the pad is designed and the method is performed in accordance with the present invention then a polishing pad is produced which avoids the disadvantages of the prior art and provides a high working ability and a long service life.

In accordance with another feature of the present invention, the temperature and pressure is applied simultaneously to the pad assembled of all above mentioned layers, so that simultaneously with vulcanization of the connection layer and connection of the working layer with the attaching layer, the polishing grains are forcedly moved by the applied pressure into the interior of an adhesive suspension of the working layer. As a result the grains are introduced deeply into the working layer so that hundred percents of their height is inside the working layer.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
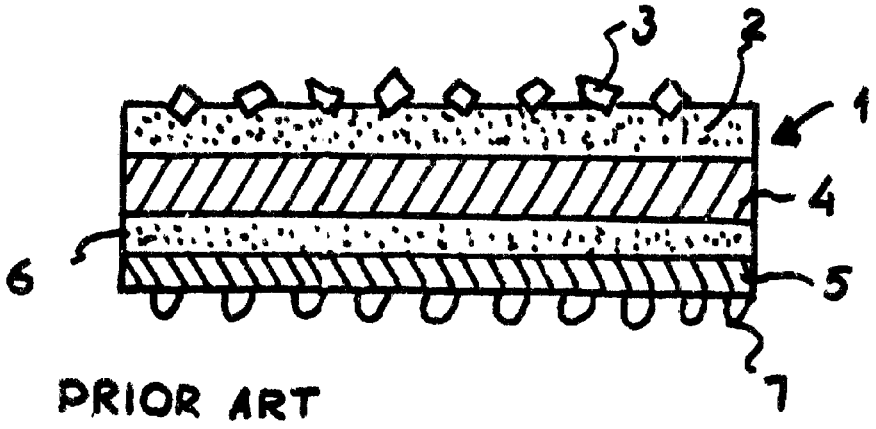
FIG. 1 is a view showing a polishing pad in accordance with the prior art.
Figure 2:
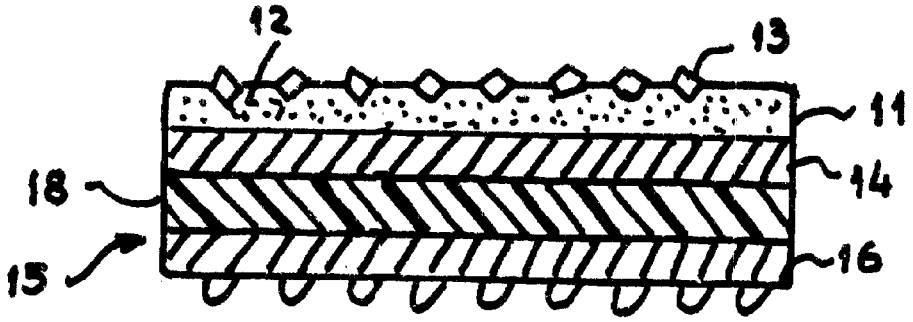
FIG. 2 is a view showing a polishing pad in accordance with the present invention before application of heat and pressure for final manufacture of the polishing pad.
Figure 3:
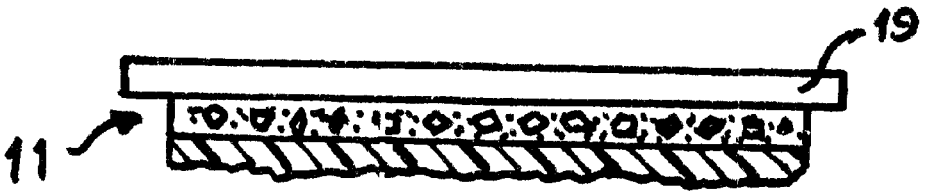
FIG. 3 is a view showing an upper part of the polishing pad of the present invention after application of the heat and pressure.

A polishing pad for polishing glass and the like in accordance with the present invention can be for example disc-shaped, and can have a working layer which is identified with reference numeral 11.

The working layer 11 can include an adhesive material 12, for example of latex adhesive, polyester resin adhesive, etc. It further includes an abrasive powder having a plurality of grains 13 supported in the adhesive material 12. The abrasive powder, for example a polishing powder can be composed of grains of $CeO_2$ and the like with the size of grains for example 1.5–5 $\mu$m.

The working layer 11 in accordance with the present invention further has a body which is identified with reference numeral 14 and composed for example of a non knitted material, for example plastic material such as polyurethane and the like.

The polishing tool further has an attaching layer 15 for attaching the polishing pad to a rotatable head of a power tool. The attaching layer 15 is formed for example as a "VELCRO-type layer and includes a support 16 and a plurality of projections formed for example as loops 17, to be connected with hooks provided on the head of the power tool.

In accordance with the present invention, the polishing pad is further provided with a connection layer which is identified with reference numeral 18. The connection layer 18 connects the working layer 11 to the attaching layer 15. The connection layer 18 in accordance with the present invention is composed of a vulcanizable material, for example of nitrylbytadiene rubber.

In order to produce the polishing pad, a suspension of the adhesive material 12 of the working layer 11 is applied on the body 14, and the abrasive powder 13 is placed on the surface of the adhesive suspension 12. Then the intermediate connection layer 18 is provided, and the "VELCRO"-type attaching layer is placed to the a lower surface of the connection layer 18. The thusly formed multi-layer structure is subjected to a temperature for example of between 140–160° C. and pressure of 0.4–0.6 MPa for 3–5 minutes. As a result the grains of the abrasive powder 13 are wetted with the adhesive of the adhesive suspension 12 and form a substantially rigid layer on the body 14 with which they are connected. At the same time the vulcanizable connection layer 18 is vulcanized and reliably, nor-releasably connects the working layer 11 to the attachment layer 15.

The same temperature and pressure can be used simultaneously to harden the working layer and to vulcanize the connection layer so as to connect the working layer and the attaching layer.

During the manufacture of the pad, in accordance with an important embodiment of the present invention, the pressure can be applied to the top by a plate, for example by a steel plate. As a result, during applying of the pressure, the grains 13 of the polishing powder are pressed into the layer of adhesive material 12 and therefore are covered by the adhesive over 100% of their height.

The polishing pad in accordance with the present invention were tested in a polishing process and compared with regular pad. All pad before and after the tests were weighted on a precise scale with deviation G±0.01 grams.

All pads were tested by hand air-powered tool at 5,000 rpm. Moreover, hand pressure was applied to the tool with the use of a very small amount of water sprayed on a scratched surface of glass.

The test results are presented in the table.

| # of pad | Type of connection of working and attaching layers | Weight of pads, grams | | | Life time of pad, min | Quality |
|---|---|---|---|---|---|---|
| | | Before | After | Difference | | |
| 1 | Regular pad | 2.51 | 2.1 | 0.40 | 12 | Working part disconnected from attaching part |
| 2 | New pad | 2.93 | 2.81 | 0.12 | 50 | No disconnection |
| 3 | New pad | 3.04 | 2.93 | 0.11 | 50 | No disconnection |

-continued

| # of pad | Type of connection of working and attaching layers | Weight of pads, grams | | | Life time of pad, min | Quality |
|---|---|---|---|---|---|---|
| | | Before | After | Difference | | |
| 4 | New pad | 2.98 | 2.87 | 0.11 | 51 | No disconnection |
| 5 | New pad | 3.10 | 2.98 | 0.12 | 50 | No disconnection |

It will be understood that each of the elements described above, or two or more together, may also find a useful application in other types of constructions differing from the types described above.

While the invention has been illustrated and described as embodied in polishing pad and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A polishing pad for polishing glass and the like, comprising a working layer including a heat hardening adhesive material with a plurality of abrasive grains in it and a heat hardenable body; an attaching layer with which the polishing pad is attachable to a polishing head of a power tool; and a connection layer which connects said working layer with said attaching layer, said connection layer being located between said body of said working layer and said attaching layer and composed of vulcanizable material, said adhesive and said body of said working layer and said connection layer being composed of materials such that said adhesive of said working layer are hardenable and said connection layer is vulcanizable substantially at a same temperature and substantially with a same pressure.

2. A polishing pad as defined in claim 1, wherein said body of said working layer is composed of plastic and said connection layer is composed of vulcanizable rubber.

3. A method of producing a polishing pads comprising the steps of providing a working layer including an adhesive material with a plurality of abrasive grains and a heat hardenable body; providing an attaching layer for attaching said working layer to a polishing head of a power tool; and connecting with said working layer to said attaching layer by a vulcanizable connection layer located between the body of said working layer and the attaching layer, under the action of and substantially a same pressure temperature which provide hardening of the adhesive material and the body of the working layer and vulcanization of the connection layer.

4. A method as defined in claim 3; and further comprising forming said body of said working layer of plastic and said connection layer of vulcanizable rubber.

* * * * *